US011053932B2

(12) United States Patent
Kim

(10) Patent No.: US 11,053,932 B2
(45) Date of Patent: Jul. 6, 2021

(54) LINEAR COMPRESSOR

(71) Applicant: LG ELECTRONICS INC., Seoul (KR)

(72) Inventor: Jeongwoo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 133 days.

(21) Appl. No.: 16/411,852

(22) Filed: May 14, 2019

(65) Prior Publication Data

US 2019/0353154 A1 Nov. 21, 2019

(30) Foreign Application Priority Data

May 16, 2018 (KR) ..... 10-2018-0056136

(51) Int. Cl.

| | |
|---|---|
| ***F04B 39/12*** | (2006.01) |
| ***F04B 35/04*** | (2006.01) |
| ***F04B 39/00*** | (2006.01) |
| *F04B 39/02* | (2006.01) |

(52) U.S. Cl.

CPC ..... *F04B 39/123* (2013.01); *F04B 35/04* (2013.01); *F04B 35/045* (2013.01); *F04B 39/00* (2013.01); *F04B 39/0005* (2013.01); *F04B 39/121* (2013.01); *F04B 39/02* (2013.01)

(58) Field of Classification Search

CPC .... F04B 39/123; F04B 39/121; F04B 39/122; F04B 39/0005; F04B 39/00; F04B 35/045; F04B 35/04

See application file for complete search history.

(56) References Cited

U.S. PATENT DOCUMENTS

| | | | | |
|---|---|---|---|---|
| 5,525,845 | A | 6/1996 | Beale et al. | |
| 9,739,276 | B2 * | 8/2017 | Muth | F04B 53/14 |
| 9,845,797 | B2 * | 12/2017 | Ki | F04B 17/03 |
| 10,352,313 | B2 * | 7/2019 | Ha | F04B 39/123 |

(Continued)

FOREIGN PATENT DOCUMENTS

| | | |
|---|---|---|
| CN | 101305186 | 11/2008 |
| CN | 101535644 | 9/2009 |

(Continued)

OTHER PUBLICATIONS

CN Office Action in Chinese Application No. 201910404718, dated Jun. 29, 2020, 13 pages (with English translation).

*Primary Examiner* — Dustin T Nguyen
(74) *Attorney, Agent, or Firm* — Fish & Richardson P.C.

(57) ABSTRACT

Provided is a linear compressor including a drive unit having a mover reciprocating within a casing and a stator and a winding coil for driving the mover, a cylinder installed inside the casing to form a compression space, a piston coupled to the mover and configured to reciprocate within the cylinder to compress a fluid accommodated in the compression space, a frame supporting the cylinder and a discharge cover coupled to the frame to form a discharge space for accommodating refrigerant compressed in the compression space, a discharge pipe extending toward an outside of the discharge cover through the discharge space and forming a passage through which the compressed refrigerant moves from the discharge space, and a branch pipe branched from the discharge pipe outside the discharge cover and configured to guide the compressed refrigerant to a space between the cylinder and the piston.

20 Claims, 5 Drawing Sheets

(56) References Cited

U.S. PATENT DOCUMENTS

| | | | | |
|---|---|---|---|---|
| 10,711,773 | B2 * | 7/2020 | Ha | F04B 39/16 |
| 2006/0051220 | A1 * | 3/2006 | Kwon | F04B 35/045 417/416 |
| 2010/0021323 | A1 * | 1/2010 | Schubert | F04B 39/123 417/416 |
| 2013/0058815 | A1 * | 3/2013 | Kim | F04B 39/023 417/437 |
| 2015/0004025 | A1 * | 1/2015 | Kang | F04B 39/0215 417/415 |
| 2016/0208790 | A1 | 7/2016 | Bhakta et al. | |

FOREIGN PATENT DOCUMENTS

| | | |
|---|---|---|
| CN | 103629082 | 3/2014 |
| CN | 107339207 | 11/2017 |
| CN | 107339225 | 11/2017 |
| KR | 20150040027 | 4/2015 |
| KR | 20160024217 | 3/2016 |

* cited by examiner

LINEAR COMPRESSOR

CROSS-REFERENCE TO RELATED APPLICATION

Pursuant to 35 U.S.C. § 119(a), this application claims the benefit of earlier filing date and right of priority to Korean Application No. 10-2018-0056136, filed on May 16, 2018, the contents of which is incorporated by reference herein in its entirety.

BACKGROUND OF THE INVENTION

1. Field of the Invention

The present invention relates to a linear compressor capable of lubricating a space between a cylinder and a piston with refrigerant flowing into the space therebetween.

2. Background of the Invention

Generally, a compressor is an apparatus that receives power from a power generating apparatus such as a motor or a turbine and compresses a working fluid such as air or refrigerant. Compressors are widely applied to industrial and household appliances, particularly, a steam compression chamber refrigeration cycle (hereinafter referred to as a "refrigeration cycle").

There are several types of compressor: a reciprocating compressor configured to compress a fluid by a linearly reciprocating piston, in which a compression chamber is formed between the piston and a cylinder, a rotary compressor configured to compress a fluid by a roller eccentrically rotating in a cylinder, a scroll compressor configured to compress a fluid by a pair of scrolls rotating in engagement with each other, and the like.

Recently, among reciprocating compressors, a linear compressor that employs a linear motor reciprocating linearly without using a crankshaft has been developed. Advantageously, a linear compressor has no mechanical loss caused by conversion of a rotational motion into a linear reciprocating motion, thereby improving efficiency and having a simple structure.

In such a linear compressor, a cylinder is placed inside a casing forming a sealed space to form a compression chamber, and a piston covering the compression chamber reciprocates within the cylinder. The fluid in the sealed space is suctioned into the compression chamber while the piston is moved to be positioned at bottom dead center (BDC), and the fluid in the compression chamber is compressed and discharged while the piston is moved to be positioned at top dead center (TDC). This process is repeated.

Meanwhile, a linear compressor may be classified into an oil-lubricated linear compressor and a gas-lubricated linear compressor according to a lubrication scheme. An oil-lubricated linear compressor has a certain amount of oil stored in a casing and is configured to lubricate a space between a cylinder and a piston by using the oil, as disclosed in patent document 1 (Korean Patent Publication No. KR10-2015-0040027). Also, a gas-lubricated linear compressor has no oil stored in a casing and is configured to lubricate a space between a cylinder and a piston by guiding a portion of refrigerant discharged from a compression space to a bearing surface between the cylinder and the piston to support the piston with the gaseous force of the refrigerant.

Compared to an oil-lubricated compressor, a gas-lubricated linear compressor may be downsized, and also has no reduction in reliability due to oil shortage because a bearing surface between a cylinder and a piston is lubricated with compressed refrigerant.

However, a conventional gas-lubricated compressor has a structure in which a high-temperature compressed refrigerant directly acts on a bearing surface between a cylinder and a piston by injecting a small amount of refrigerant into the bearing surface to support the piston by the gaseous force of the refrigerant. Thus, since the piston is supported by the refrigerant having irregular pressure, the behavior of the piston may be unstable. In addition, there is a risk of friction loss or abrasion due to contact between a piston and a cylinder during operation of a compressor, and compressed refrigerant has a high temperature, thereby decreasing reliability along with a reduction in compressor efficiency.

Accordingly, there is a need for a solution capable of stably supporting a piston by compressed refrigerant flowing into a space between the piston and a cylinder depending on an operational state under an initial start condition or a steady-state operation condition of a compressor and also capable of preventing a collision between the piston and the cylinder to improve reliability.

RELATED ART DOCUMENT

Patent Document (Patent Document 1) Korean Patent Publication No. KR10-2015-0040027A (published on Apr. 14, 2015)

(Patent Document 2) Korean Patent Publication No. KR10-2016-0024217A (published on Mar. 4, 2016)

SUMMARY OF THE INVENTION

Therefore, an aspect of the detailed description is to provide a linear compressor structure capable of supplying compressed refrigerant to a space between a cylinder and a piston and support load of the piston.

Also, the present invention provides a linear compressor structure capable of stably maintaining a support force applied to a piston while lowering the temperature of compressed refrigerant applied to the piston to support the piston.

Also, the present invention provides a linear compressor structure capable of preventing the occurrence of abrasion between a cylinder and a piston during operation of a compressor to improve efficiency according.

To achieve these and other advantages and in accordance with the purpose of this specification, as embodied and broadly described herein, there is provided a linear compressor including a drive unit having a mover reciprocating within a casing and a stator and a winding coil for driving the mover; a cylinder installed inside the casing to form a compression space; a piston coupled to the mover and configured to reciprocate within the cylinder to compress a fluid accommodated in the compression space; a frame supporting the cylinder and a discharge cover coupled to the frame to form a discharge space for accommodating refrigerant compressed in the compression space; a discharge pipe extending toward an outside of the discharge cover through the discharge space and forming a passage through which the compressed refrigerant moves from the discharge space; and a branch pipe branched from the discharge pipe outside the discharge cover and configured to guide the compressed refrigerant to a space between the cylinder and the piston.

The linear compressor may further include a refrigerant inflow passage recessed along an outer circumferential surface of the cylinder and configured to accommodate refrigerant flowing along the branch pipe.

In this case, a first gas hole may be formed in the cylinder through a side portion of the cylinder, and the compressed refrigerant may be applied to the piston.

Also, the refrigerant moving along the discharge pipe may be accommodated in the refrigerant inflow passage via the brand pipe and then may be supplied to a bearing surface between the cylinder and the piston through the first gas hole.

According to another embodiment of the present invention, the refrigerant discharged from the discharge space may move along the branch and may be applied to an outer surface of the piston through the first gas hole.

In this case, the first gas hole may be provided in plurality, and the plurality of first gas holes may be formed at different positions of an inner circumferential surface of the cylinder depending on a moving direction of the piston.

Also, the plurality of first gas holes may be formed at a plurality of places at regular intervals along an inner surface of the cylinder.

According to another embodiment of the present invention, an accommodation recess recessed to a certain depth from one end of the first gas hole may be formed on one side of an inner circumferential surface of the cylinder so that the refrigerant moving from the first gas hole is applied to the piston with an expanded flow path area.

In this case, the accommodation recess may be formed in plurality along an inner circumferential surface of the cylinder.

According to an embodiment of the present invention, the piston may include a piston body extending along an inner space of the cylinder, and an inclined portion having a diameter decreasing such that an outer surface of the piston body and an inner surface of the cylinder are maintained at a predetermined distance may be formed in the piston body.

In this case, the inclined portion may include a first inclined portion formed on a front side of the piston body, the first inclined portion having a diameter decreasing in a direction toward the front side of the piston body while maintaining an external circumferential surface of the piston body and an inner circumferential surface of the cylinder at a predetermined distance, and a second inclined portion formed on a rear side of the piston body, the second inclined portion having a diameter decreasing in a direction in which the piston body extends.

Also, the second inclined portion may be configured to have at least one chamfer formed at different angles to have multiple inclinations.

In this case, the first inclined portion and the second inclined portion may be inclined at an angle ranging from 0.1 degrees to 0.7 degrees with respect to an outer end of the piston body.

According to another embodiment of the present invention, the piston may further include a flange part extending radially at a rear end of the piston body.

Advantageous Effects of the Invention

According to the present invention, which is configured by the above-mentioned solution means, the following effects can be obtained.

With the linear compressor according to the present invention, compressed refrigerant flows into a space between a piston and a cylinder circuitously through a branch pipe branched from a discharge pipe. Accordingly, it is possible to stably support the piston because the temperature and pressure of compressed refrigerant flowing from a discharge space are reduced, and also it is possible to improve compressor efficiency by reducing irregular pulsation.

Further, by the compressed refrigerant flowing into a space between the cylinder and the piston to support the piston and by inclined portions formed on front and rear sides of the piston, the piston and the cylinder may be maintained at a predetermined distance, and thus it is possible to reduce the occurrence of abrasion due to operation of the compressor. Accordingly, it is possible to improve efficiency of the linear compressor.

DETAILED DESCRIPTION OF THE INVENTION

Hereinafter, a linear compressor according to the present invention will be described in detail with reference to the accompanying drawings.

In describing embodiments disclosed in the specification, moreover, the detailed description will be omitted when a specific description for publicly known technologies to which the invention pertains is judged to obscure the gist of the embodiments disclosed in the specification.

Also, the accompanying drawings are merely illustrated to easily understand the embodiments disclosed in the specification, and therefore, they should not be construed to limit the technical spirit disclosed in the specification, and it is to be understood that the invention includes all modifications, equivalents, and alternatives falling within the spirit and scope of the invention.

As used herein, the singular forms "a," "an," and "the" are intended to include the plural forms as well, unless the context clearly indicates otherwise.

The linear compressor according to the present invention performs an operation of suctioning and compressing fluid and discharging the compressed fluid. The linear compressor according to the present invention may be an element of a steam compression refrigeration cycle. Hereinafter, a fluid will be described below by taking a refrigerant circulating in the refrigeration cycle as an example.

Figure 1:
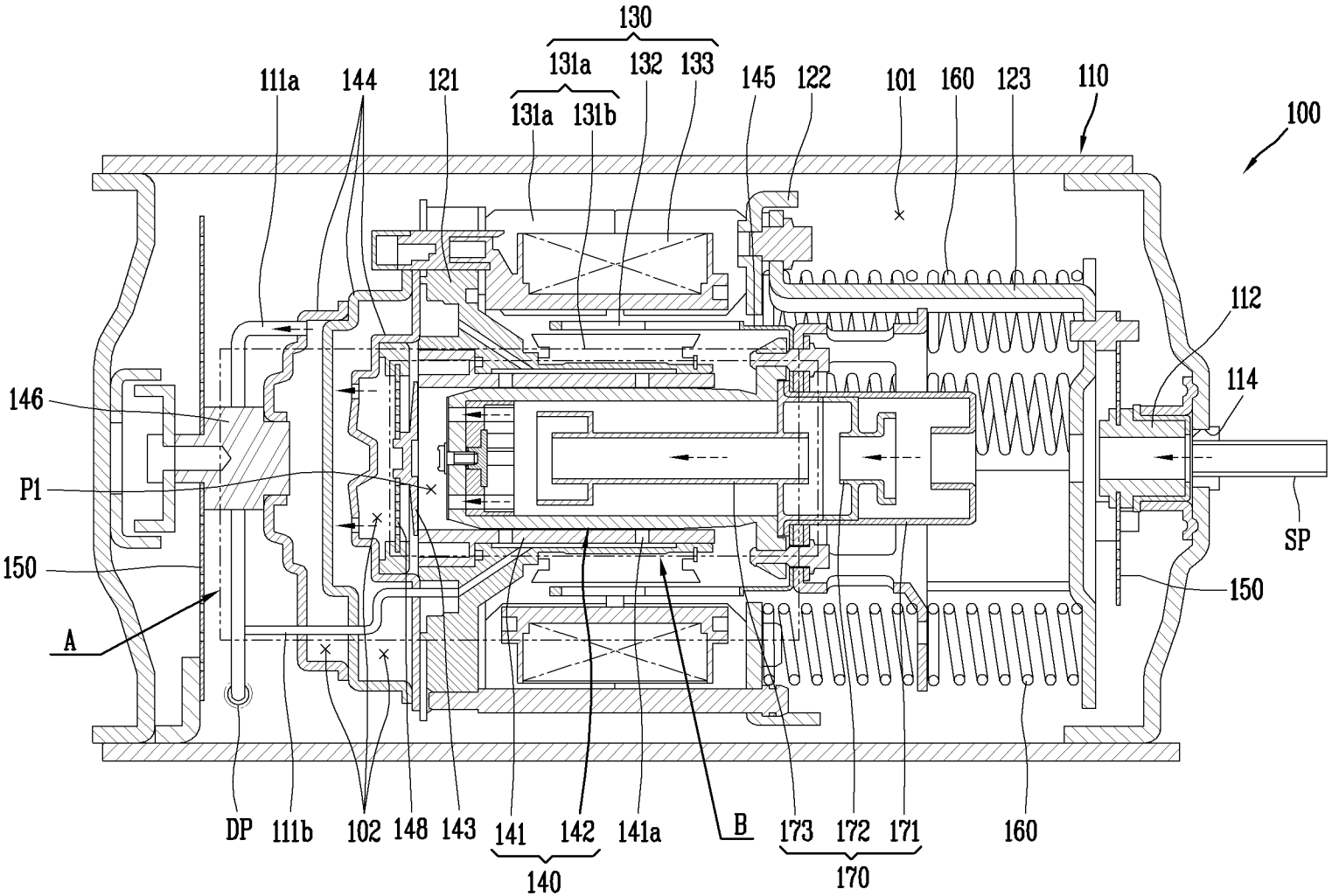
FIG. 1 is a sectional view showing a linear compressor according to the present invention.

FIG. 1 is a sectional view showing the linear compressor according to the present invention.

The linear compressor 100 of the present invention includes a casing 110, a drive unit 130, and a compression unit 140.

The casing 110 may form a sealed space. Here, the sealed space may indicate a suction space 101 into which refrigerant is suctioned and which is filled with the refrigerant. In order to suction refrigerant into the suction space 101, an inlet 114 may be formed in a casing 110, and a suction pipe SP may be installed in the casing 110 A discharge pipe DP may be connected to the casing 110 in order to discharge compressed refrigerant from a discharge space P2 to the outside.

A frame 121 for supporting the drive unit 130 and the compression unit 140 may be formed inside the casing 110. Here, the frame 121 may refer to front and rear frames coupled to both ends of a stator 131, which will be described later. A cylinder 141 may be connected to a center portion of the frame 121.

The drive unit 130 serves to generate a reciprocating motion of the linear compressor 100. The drive unit 130 may include a stator 131 and a mover 132. The stator 131 may be coupled to the frame 121. The stator 131 may include an outer core 131*a* placed to surround the compression unit 140, which will be described later, and an inner core 131*b* spaced inward from the outer core 131*a* to surround the compression unit 140. The mover 132 may be placed between the outer core 131*a* and the inner core 131*b*.

A winding coil 133 may be mounted on the outer core 131*a*, and the mover 132 has a magnetic substance. When an electric current is applied to the drive unit 130, a magnetic flux may be formed in the stator 131 by the winding coil 133. An electromagnetic force for forming movement of the mover 132 may be generated by an interaction between the magnetic flux formed by applying the electric current and the magnetic flux formed by the magnetic substance.

The compression unit 140 serves to suction refrigerant from the suction space 101, compress the suctioned refrigerant, and discharge the compressed refrigerant. The compression unit 140 may be located at the center portion of the casing 110 inward from the inner core 131*b*. The compression unit 140 may include a cylinder 141 and a piston 142. The cylinder 141 is supported by the front frame 121 and forms a compression space P1 therein. The cylinder 141 may have a cylindrical shape with both ends open. One end of the cylinder 141 may be closed by a discharge valve assembly 143 and a discharge cover 144, and the other end may be formed to accommodate the piston 142. The discharge valve assembly 143 may be understood to refer to a typically used discharge valve.

The discharge space P2 may be formed between the discharge valve assembly 143 and the discharge cover 144. As shown, the compression space P1 and the discharge cover 144 may form spaces to be separated from each other by the discharge valve assembly 143. The discharge valve assembly 143 may be supported by the valve spring 148 and may be moved to open and close a first open end of the cylinder 141. The valve spring 148 may refer to a typically used elastic member.

A discharge pipe 111 extending to allow an outlet and the discharge pipe DP to communicate with the discharge space P2 may be installed inside the casing 110. The discharge pipe 111 serves to move compressed refrigerant discharged from the discharge space to the outside through the discharge pipe DP. The linear compressor 100 according to the present invention has a structure in which the compressed refrigerant flows into a space between the cylinder 141 and the piston 142 so that the piston is supported inside the cylinder. This will be described in detail below.

The piston 142 is inserted into a second open end of the cylinder 141 and serves to seal the compression space P1. The piston 142 may be connected to the mover 132, which has been described above, to reciprocate together with the mover 132. The inner core 131*b* and the cylinder 141 may be located between the mover 132 and the piston 142. The mover 132 and the piston 142 may be coupled to each other by a separate moving frame 145 formed to bypass the cylinder 141 and the inner core 131*b*.

A suction port 142*a* configured to communicate with one end of the compression space P1 passes through the piston 142. Via an inner space formed in the piston 142, refrigerant in the suction space 101 passes through the suction port 142*a* and then is suctioned into the compression space P1 between the piston 142 and the cylinder 141. Also, a suction valve 142*b* configured to open and close the suction port 142*a* may be mounted at one end of the piston 142 adjacent to the compression space P1.

The suction valve 142*b* may be operated by elastic deformation. The suction valve 142*b* is elastically deformed by the pressure of refrigerant flowing toward the compression space P1 via the suction port 142*a* to open the suction port 142*a*.

The drive unit 130 and the compression unit 140 may be supported by a support spring 150 and a resonance spring 160. The support spring 150 and the compression unit 140 serve to elastically support the drive unit 130 and the compression unit 140 to the casing 110. The support spring 150 may be configured to support the drive unit 130 and the compression unit 140 at both ends depending on the direction in which the piston 142 reciprocates. The support spring 150 may be a leaf spring.

The resonance spring 160 to be installed in the linear compressor 100 may be formed in plurality, and the resonance spring 160 serves to effectively compress refrigerant by amplifying vibration caused by the reciprocation of the mover 132 and the piston 142.

A connection member 146 to be installed inside the casing 110 may be coupled to one end of the discharge cover 144. The connection member 146 may be fixed at a center portion of the support spring 150 and may be fixed on an inner wall of the casing 110 in an external circumferential portion of the support spring 150.

Also, the support spring 150 installed at another end may have a center portion fixed in a suction guide 112 formed to protrude from the inlet 114 to the inside of the casing 110 and an outer circumferential portion fixed by a cover member 123 coupled to a rear frame 122.

The resonance spring 160 may be located between the rear frame 122 and the cover member 123. The resonance spring 160 may be a coil spring. The resonance spring 160 may have both ends connected to a fixed body and a vibrating body.

The first end of the resonance spring 160 may be connected to the moving frame 145, and the second end of the resonance spring 160 may be connected to the cover member 123. Thus, the resonance spring 160 may be elastically deformed between the vibrating body that vibrates at the first end and the fixed body that is fixed at the second end. The natural frequency of the resonance spring 160 may be designed to coincide with the reference frequency of the mover and the piston 142 during operation of the compressor to amplify the reciprocation of the piston 142. However, the fixed body is elastically supported against the casing 110 by the support spring 150, and thus may not be strictly fixed during operation of the compressor.

The linear compressor 100, which has been described above, operates as follows.

When an electric current is applied to the drive unit 130, a magnetic flux is formed in the stator 131 by the current flowing in the winding coil 133. Through an interaction with an electromagnetic force generated by the magnetic flux formed in the stator 131, the mover 132 with the magnetic substance may be linearly reciprocated. The electromagnetic force may be alternately generated in a direction in which the piston 142 is toward TDC during a compression stroke and in a direction in which in which the piston 142 is toward BDC during a suction stroke. That is, the drive unit 130 may generate a thrust, which is a force of pushing the mover 132 and the piston 142 in a moving direction.

Meanwhile, the piston 142 may reciprocate within the cylinder 141 to increase or decrease the volume of the compression space P1. When the piston 142 moves to increase the compression space P1, the pressure in the compression space P1 decreases. In this case, the suction valve 142*b* installed at the piston 142 is open so that the refrigerant staying in the suction space 101 may be suctioned into the compression space P1. Such a suction stroke proceeds until the piston 142 maximally increase the volume of the compression space P1 to reach BDC.

Once the piston 142 reaches BDC, the motion direction is switched, and the piston 142 decreases the volume of the compression space P1 to perform a compression stroke. The compression stroke is performed while the piston 142 moves up to TDC, at which the volume of the compression space P1 is reduced to a minimum. During the compression stroke, the pressure in the compression space P1 increases so that the suctioned refrigerant may be compressed. When the pressure of the compression space P1 reaches a predetermined pressure, the discharge valve assembly 143 is open by being pushed out by the pressure of the compression space P1 and thus separated from the cylinder 141 so that the refrigerant may be discharged into the discharge space P2.

The suction and compression strokes of the piston 142 are repeated so that a flow of refrigerant may be formed in which the refrigerant in the suction space P2, which has flowed into the inlet 114, is suctioned into and compressed in the compression space P1 and then discharged to the outside via the discharge space P2, the discharge pipe 111, and the outlet.

Also, the linear compressor 100 according to the present invention has a structure capable of applying a load-bearing capacity to the piston 142 by a gaseous pressure of the compressed refrigerant flowing to the bearing surface 141*d* formed between the cylinder 141 and the piston 142. Even when the piston 142 reciprocates within the cylinder 141, a sufficient load-bearing capacity can be ensured. Thus, it is possible to prevent unnecessary abrasion between the cylinder 141 and the piston 142, thus achieving a smooth reciprocating motion.

Also, the refrigerant compressed by reciprocation of the piston 142 moves through a discharge pipe 111*a* and flows into the bearing surface 141*d* between the piston 142 and the cylinder 141 circuitously through a branch pipe 111*b* branched from the discharge pipe 111*a*. Thus, since the compressed refrigerant flowing from the discharge space P2 is applied to the piston 142 while the temperature and pressure of the refrigerant are reduced, it is possible to reduce irregular pulsation and thus improve compressor efficiency.

Figure 2A:
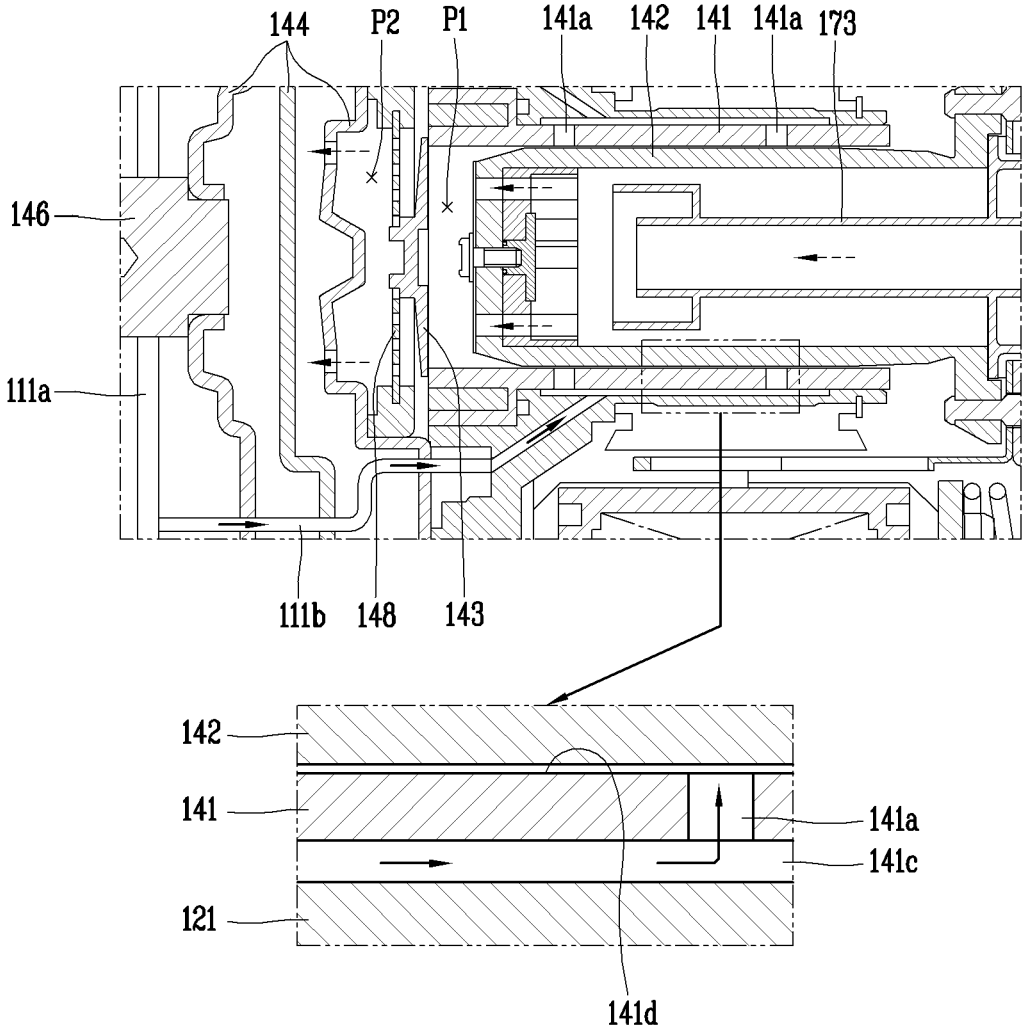
FIG. 2A is an enlarged view showing an embodiment of a linear compressor.

FIG. 2A is a diagram showing another embodiment of the linear compressor 100.

The linear compressor 100 according to the present invention has a discharge pipe 111*a* installed inside the casing 110 to extend to allow the outlet and the discharge pipe DP to communicate with the discharge space P2.

The linear compressor 100 has a structure in which refrigerant passing through an inlet and a suction guide flows into a suction space and then a compression space P1 via a muffler assembly 173. The refrigerant having flowed into the compression space P1 is compressed by reciprocation of the piston 142 located inside the cylinder and is moved to the discharge space P2 formed by the discharge cover 144 when the discharge valve assembly 143 is open. The compressed refrigerant is moved to the discharge space P2 along the discharge pipe 111*a*.

A first gas hole 141*a* passing through the inside and outside of the cylinder 141 may be formed on an inner circumferential surface of the cylinder 141, and the compressed refrigerant may be applied to an outer surface of the piston 142. The compressed refrigerant discharged from the discharge space P2 flows into a refrigerant inflow passage 141*c* through the discharge pipe 111*a* and then is supplied to the bearing surface 141*d* formed between the cylinder 141 and the piston 142 via the first gas hole 141*a*. Accordingly, the space between the piston 142 and the cylinder 141 may be lubricated with a gaseous force.

The discharge pipe 111*a* serves to move compressed refrigerant discharged from the discharge space P2 to the outside through the discharge pipe DP. In the linear compressor 100 according to the present invention, the compressed refrigerant flows into a space between the cylinder 141 and the piston 142 so that the piston 142 may be supported inside the cylinder 141.

In this case, when the compressed refrigerant is supplied to the bearing surface 141*d* between the piston 142 and the cylinder 141 through the first gas hole 141*a* directly after the compressed refrigerant flows from the discharge space P2 into the discharge pipe 111*a*, the refrigerant with relatively high temperature and pressure reflows into the compression space P1. This results in an ineffective work, which causes a rise in the temperature of the refrigerant flowing into the compression space P1, thereby reducing volume efficiency and hindering improvement of compressor efficiency. Also, when compressed refrigerant with irregular pulsation is directly supplied from the discharge space P2 to the space between the piston 142 and the cylinder 141, an external force for supporting the piston 142 is made irregular by the compressed refrigerant, which would adversely affect reliability.

In order to prevent this effect, the linear compressor 100 according to the present invention includes a discharge pipe 111*a* passing through the discharge space P2, extending outward from the discharge cover, and forming a path through which the compressed refrigerant moves from the discharge space P2. A branch pipe 111*b* branched from the discharge pipe 111*a* to guide the compressed refrigerant to the space between the cylinder 141 and the piston 142 is installed on one side of the discharge pipe 111*a*.

As shown in FIG. 2A, the compressed refrigerant moving along the discharge pipe 111*a* from the discharge space P2 moves along the branch pipe 111*b*, flows into the refrigerant inflow passage 141*c*, and passes through the cylinder 141. Then, the compressed refrigerant is supplied to the bearing surface 141*d* between the cylinder 141 and the piston 142 along the first gas hole 141*a* communicating with the refrigerant inflow passage 141*c*. In this case, the compressed refrigerant has a relatively low temperature compared to a case in which the compressed refrigerant is directly supplied from the discharge space P2. Thus, the occurrence of an ineffective work caused by the refrigerant reflowing into the compression space P1 may be restricted, and the temperature rise of the refrigerant flowing into the compression space P1 may be prevented, thereby reducing volume efficiency and improving compressor efficiency.

Figure 2B:
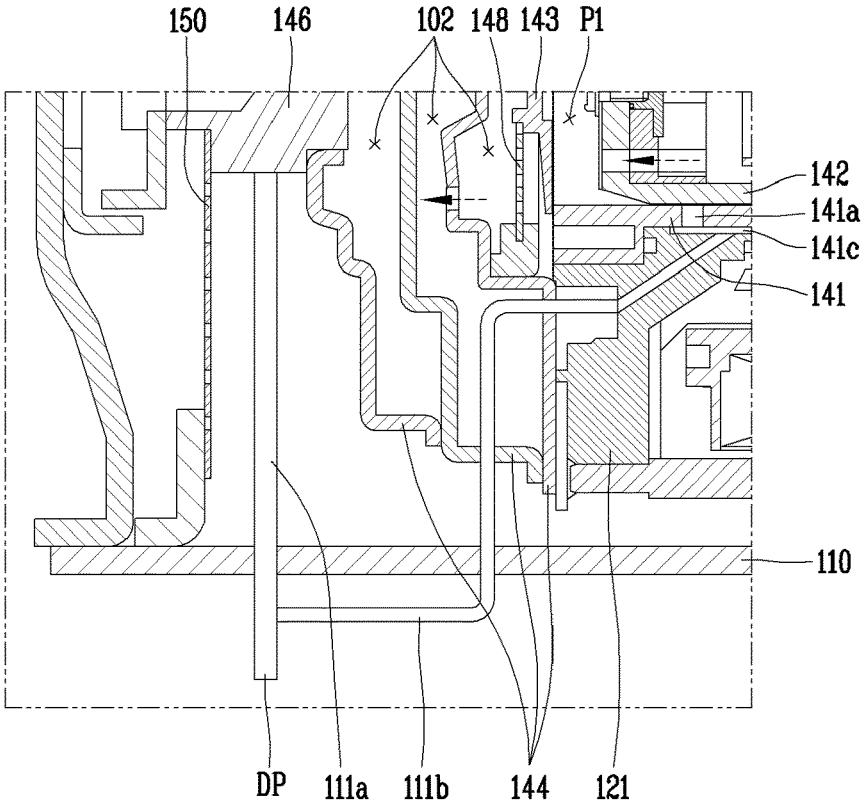
FIG. 2B is an enlarged view showing another embodiment of a linear compressor.

Also, the compressed refrigerant is supplied to the space between the cylinder 141 and the piston 142 through the branch pipe 111*b* branched from the discharge pipe 111*a*. Accordingly, the compressed refrigerant may be stably supplied, and thus the gaseous force applied to the piston 142 may be kept constant, thus preventing unnecessary vibration. FIG. 2B is a sectional view showing another embodiment of the present invention.

The compressed refrigerant moving along the discharge pipe 111*a* from the discharge space P2 moves along the branch pipe 111*b* and flows into the refrigerant inflow passage 141*c*. Then, the compressed refrigerant is supplied to the bearing surface 141*d* between the cylinder 141 and the piston 142 along the first gas hole 141*a* communicating with the refrigerant inflow passage 141*c* through the cylinder 141. In this case, as shown in FIG. 2B, the branch pipe 111*b* is not branched from the discharge pipe 111*a* inside the casing 110, and the discharge pipe 111*a* extending outward with respect to the casing 110 is branched from the outside of the casing 110. The compressed refrigerant may be circuitously supplied toward the refrigerant inflow passage 141*c* through the casing 110 and the discharge cover 144. In this case, the compressed refrigerant moving along the branch pipe 111*b* flows toward the refrigerant inflow passage 141*c* via the outside of the casing 110 because the moving path is elongated. Therefore, by lowering the temperature of the refrigerant flowing into the compression space P1, it is possible to reduce volume efficiency and thus to more effectively improve compressor efficiency.

Figure 3:
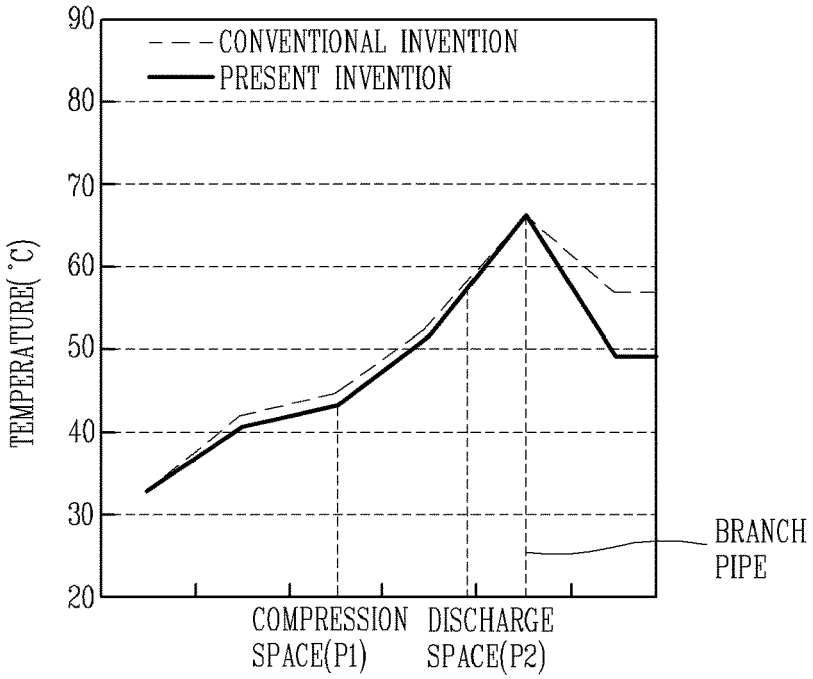
FIG. 3 is a graph showing comparison of temperatures at points of a compressor between when a branch pipe branched from a discharge pipe is installed and when no branch pipe is installed.

FIG. 3 is a graph showing comparison of temperatures at points of a compressor between when the branch pipe 111*b* branched from the discharge pipe 111*a* is installed and when no branch pipe is installed.

In the linear compressor 100 according to the present invention, the compressed refrigerant moving along the discharge pipe 111*a* via the discharge space P2 flows into the refrigerant inflow passage 141C circuitously via the branch pipe 111*b* branched from the discharge pipe 111*a*. The compressed refrigerant is sharply reduced through the branch pipe 111*b*. On the other hand, in the case of a convention invention in which the branch pipe 111*b* branched from the discharge pipe 111*a* is not present, the temperature of the compressed refrigerant when the refrigerant is supplied to the piston 142 through the first gas hole 141*a* is relatively high compared to the present invention.

When the branch pipe 111*b* branched from the discharge pipe 111*a* is present, as described above, it is possible to improve compressor efficiency, and also to improve reliability because a support force for supporting the piston 142 may be stably applied.

Figure 4:
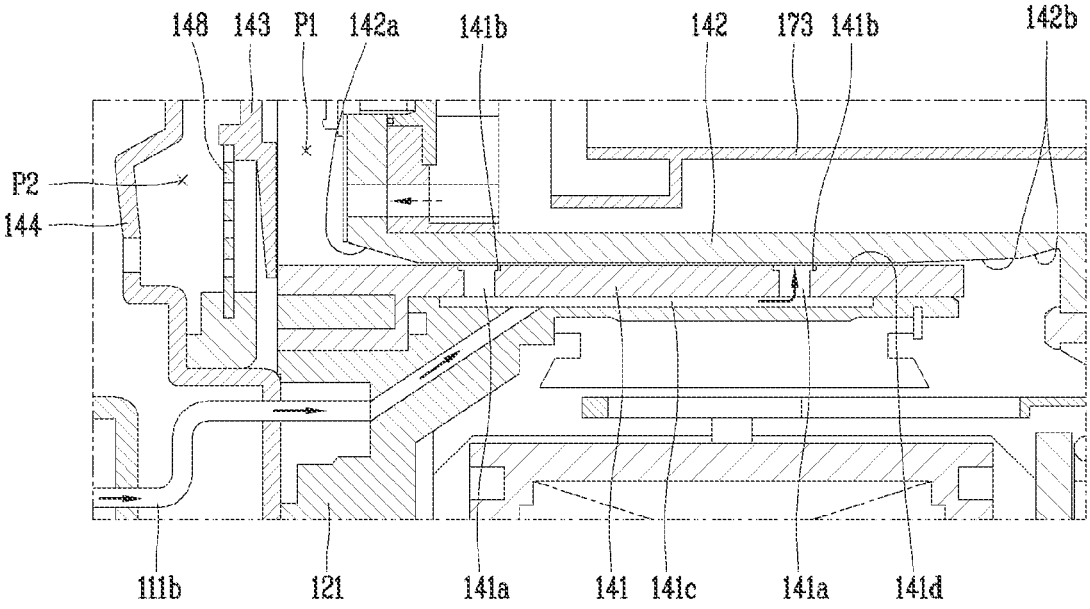
FIG. 4 is an enlarged view showing an embodiment of a linear compressor according to the present invention.
Figure 5:
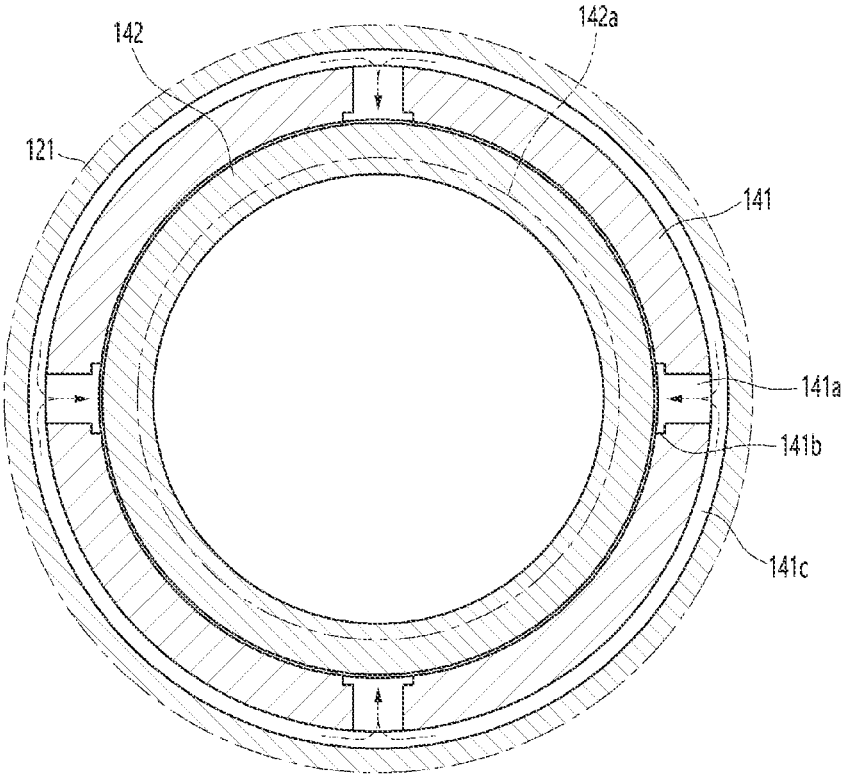
FIG. 5 is a longitudinal sectional view of the linear compressor according to the embodiment of FIG. 4.

FIG. 4 is a diagram showing another embodiment of the linear compressor 100 according to the present invention, and FIG. 5 is a longitudinal sectional view of the linear compressor 100.

First gas holes 141*a* of the linear compressor 100 may be formed at a plurality of points at regular intervals along the inner circumference of the cylinder 141. As shown in FIG. 5, the first gas holes 141*a* may be formed in the cylinder 141 to pass through the cylinder 141 at regular intervals.

A plurality of such first gas holes 141*a* may be formed along an outer surface of the cylinder at regular intervals. The first gas holes 141*a* communicate with the refrigerant inflow passage 141*c* formed between the frame 121 and the outer surface of the cylinder 141 so that the compressed refrigerant may be supplied to a space between the inner circumferential surface of the cylinder 141 and the outer circumferential surface of the piston 142.

In this case, in the linear compressor 100 according to this embodiment, an accommodation recess 141*b* may be formed at one side of the inner circumferential surface of the cylinder 141, as shown in FIG. 4. The accommodation recess 141*b* serves to expand a flow path area of the refrigerant moving from the first gas hole 141*a* and is recessed to have a certain depth from one end of the first gas hole 141*a*. The compressed refrigerant moving along the first gas hole 141*a* may be applied to the piston 142 via the accommodation recess 141*b*, and thus the gaseous force of the compressed refrigerant may act on a relatively large area of the outside of the piston 142.

That is, the gaseous force of the compressed refrigerant may act on the greater area of the piston 142 through the accommodation recess 141*b*. The uniform gaseous force acts on the piston 142, and thus it is possible to prevent unnecessary vibration from being generated in the piston 142. Thus, the piston 142 may be stably supported against the cylinder 141, and thus it is possible to improve reliability of the gas bearing.

Figure 6:
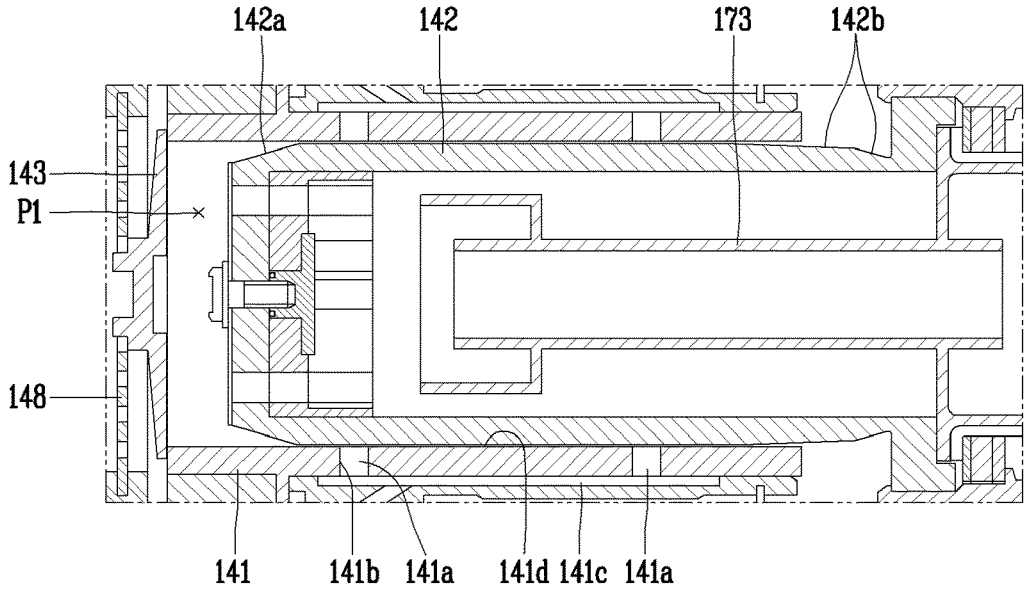
FIG. 6 is a sectional view showing an internal structure of the linear compressor according to the present invention.

FIG. 6 is a sectional view showing an internal structure of the linear compressor 100 according to the present invention.

The linear compressor 100 has a structure in which refrigerant passing through an inlet and a suction guide flows into a suction space and then a compression space P1 via a muffler assembly 173. The refrigerant having flowed into the compression space P1 is compressed by reciprocation of the piston 142 located inside the cylinder and is moved to the discharge space P2 formed by the discharge cover 144 when the discharge valve assembly 143 is open. The compressed refrigerant is moved to the discharge space P2 along the discharge pipe 111*a*.

The linear compressor 100 according to the present invention is configured to allow the compressed refrigerant flowing into the discharge space P2 to flow into a space between the piston 142 and the cylinder 141, support the piston 142 using a gaseous force of the refrigerant, and lubricate the space between the cylinder 141 and the piston 142.

As shown in FIG. 6, a first gas hole 141*a* passing through the inside and outside of the cylinder 141 may be formed on an inner circumferential surface of the cylinder 141, and the compressed refrigerant may be applied to an outer surface of the piston 142. The compressed refrigerant discharged from the discharge space P2 flows into a refrigerant inflow passage 141*c* through the discharge pipe 111*a* and then is supplied to the bearing surface 141*d* formed between the cylinder 141 and the piston 142 via the first gas hole 141*a*. Accordingly, the space between the piston 142 and the cylinder 141 may be lubricated with a gaseous force.

The refrigerant inflow passage 141*c* is recessed in one direction along the outer circumferential surface of the cylinder 141 and serves to guide the movement of the refrigerant between the outer circumferential surface of the piston 142 and the inner circumferential surface of the cylinder 141.

In this case, such first gas holes 141*a* may be formed at different positions of the inner circumferential surface of the cylinder 141 along the moving direction of the piston 142 and may be spaced a certain distance from one another. The first gas holes 141*a* may be formed at a plurality of places at regular intervals along the inner circumferential surface of the cylinder 141.

Figure 7:
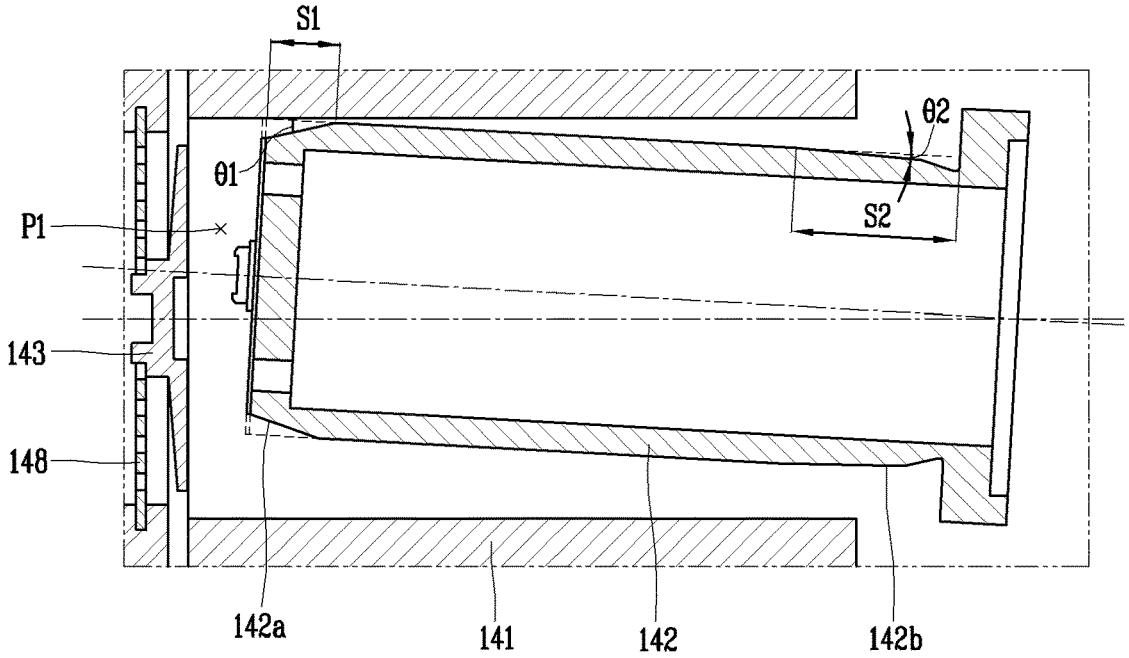
FIG. 7 is a conceptual enlarged view of a piston and a cylinder during operation of the linear compressor according the present invention.

FIG. 7 is a conceptual enlarged view of the piston 142 and the cylinder 141 during operation of the linear compressor 100 according to the present invention.

Since the reciprocating motion of the piston 142 located inside the cylinder 141 is done during operation of the compressor, there is a possibility that metal contact will occur between the outer surface of the piston 142 and the inner surface of the cylinder 141. Accordingly, the piston 142 of the linear compressor 100 according to the present invention has inclined portions 142*a* and 142*b* on front and rear sides, respectively, so that the piston 142 may maintain a predetermined distance from the inner circumferential surface of the cylinder 141.

The piston 142 includes a piston body (not shown) extending along the inner space of the cylinder 141 and a flange part extending radially from one end of the piston body.

The piston body is formed in a cylindrical shape to form an external appearance of the piston 142, and serves to form a compression space P1 with the cylinder 141 and reciprocate within the cylinder 141 to compress refrigerant flowing into the compression space P1.

The flange part (not shown) may be formed at the rear end of the piston 142 in a direction intersecting the direction in which the piston body extends. The flange part serves to restrict the movement distance of the piston 142 reciprocating within the cylinder 141 and is coupled to the mover to allow the reciprocating motion of the piston 142.

The inclined portions 142*a* and 142*b* are formed on the front and rear sides of the piston 142.

The inclined portions 142*a* and 142*b* may include a first inclined portion 142*a* formed on the front side of the piston 142, the inclined portion 142*a* having a diameter decreasing in a direction toward the front side of the piston body while maintaining an external circumferential surface of the piston body and an inner circumferential surface of the cylinder 141 at a predetermined distance, and a second inclined portion 142*b* formed on the rear side of the piston body, the second inclined portion 142*b* having a diameter decreasing in the direction in which the piston body extends.

The first inclined portion 142*a* may be chamfered at a predetermined angle θ1 from the front end of the piston 142 up to a certain length S1. In this case, the first inclined portion 142*a* may be inclined at an angle of approximately 0.1 degree to 0.7 degree with respect to the outer end of the piston body. As shown in FIG. 7, when the piston 142 reciprocates according to operation of the compressor, the first inclined portion 142*a* may prevent abrasion caused by friction with the front inner surface of the cylinder 141.

Also, the second inclined portion 142*b* may be chamfered forward at a predetermined angle θ2 from the rear end of the piston body up to a certain length S2.

The second inclined portion 142*b* may be formed on the rear side of the piston body and may be chamfered at different angles to have multiple inclinations. Unlike the first inclined portion 142*a*, the second inclined portion 142*b* is likely to come into contact with one end of the cylinder 141. Thus, by forming the second inclined portion 142*b* to have multiple inclinations at a connection portion between the piston body and the flange part, it is possible to prevent abrasion between the piston 142 and the cylinder 141. In this case, it is preferable that the formation angle of the second inclined portion 142*b* gradually decreases toward the front of the piston 142.

For example, the angle θ2 of the multiple inclinations of the second inclined portion 142*b* may be configured to range from 0.1 degrees to 0.7 degrees with respect to the outer end of the piston body. As shown in FIG. 7, the second inclined portion 142*b* may be formed to have two different angles. Preferably, an angle on the front side (to the left in the drawing) of the piston 142 may be smaller than an angle on the rear side (to the right in the drawing) of the piston 142. Since the second inclined portion 142*b* formed in the piston 142 limits the contact of the inner surface of the rear side of the cylinder 141, it is possible to prevent the occurrence of abrasion.

When the compressed refrigerant flowing into the refrigerant inflow passage 141*c* is applied to the outer surface of the piston 142 through the first gas hole 141*a*, the first inclined portion 142*a* and the second inclined portion 142*b* serve to increase the area where the compressed refrigerant is applied, and thus the load of the piston 142 may be smoothly supported by the gaseous force of the compressed refrigerant. There, it is possible to prevent the occurrence of abrasion between the cylinder 141 and the piston during operation of the compressor.

The above description is only an embodiment for implementing the linear compressor 100 according to the present invention, and the present invention is not limited to the above embodiment. It will be understood by those skilled in the art that various changes in form and details may be made therein without departing from the spirit and scope of the invention as defined in the appended claims.

What is claimed is:

1. A linear compressor comprising:

a casing;

a drive unit comprising:

a stator disposed in the casing, a mover configured to reciprocate within the casing relative to the stator, and a winding coil configured to drive the mover;

a cylinder that is disposed inside the casing and defines a compression space configured to accommodate refrigerant;

a piston coupled to the mover and configured to reciprocate within the cylinder relative to the cylinder, the piston being configured to compress the refrigerant accommodated in the compression space;

a frame that supports the cylinder;

a discharge cover that is coupled to the frame and that defines a discharge space configured to receive refrigerant compressed in the compression space;

a discharge pipe that extends from the discharge space toward an outside of the discharge cover and that defines a passage configured to guide refrigerant discharged from the discharge space, the discharge pipe extending from the discharge cover to an outside of the casing; and a branch pipe branched from the discharge pipe at the outside of the casing and configured to guide refrigerant toward a space defined between the cylinder and the piston.

2. The linear compressor of claim 1, further comprising a refrigerant inflow passage that extends along an outer circumferential surface of the cylinder and that is configured to receive refrigerant guided from the branch pipe.

3. The linear compressor of claim 2, wherein the cylinder defines a first gas hole that passes through a side portion of the cylinder and that is configured to discharge refrigerant to the piston.

4. The linear compressor of claim 3, wherein the cylinder and the piston define a bearing surface disposed between the cylinder and the piston and configured to receive refrigerant from the refrigerant inflow passage through the first gas hole.

5. The linear compressor of claim 3, wherein the branch pipe is configured to guide refrigerant discharged from the discharge space and allows the refrigerant discharged from the discharge space to be supplied to an outer surface of the piston through the first gas hole.

6. The linear compressor of claim 5, wherein the first gas hole is one of a plurality of first gas holes that pass through the side portion of the cylinder, that are configured to discharge refrigerant to the piston, and that are disposed at a plurality of positions along a moving direction of the piston, and wherein the branch pipe is configured to allow the refrigerant discharged from the discharge space to be supplied to the outer surface of the piston through the plurality of first gas holes.

7. The linear compressor of claim 6, wherein the plurality of first gas holes are arranged with a regular interval along an inner circumferential surface of the cylinder.

8. The linear compressor of claim 5, wherein the cylinder defines an accommodation recess that extends from an end of the first gas hole and that is disposed at an inner circumferential surface of the cylinder, the accommodation recess defining an expanded flow path area configured to apply refrigerant received through the first gas hole to the piston.

9. The linear compressor of claim 8, wherein the first gas hole is one of a plurality of first gas holes that pass through the side portion of the cylinder, that are configured to discharge refrigerant to the piston, and that are defined at a plurality of positions along a moving direction of the piston, wherein the accommodation recess is one of a plurality of accommodation recesses that are disposed along the inner circumferential surface of the cylinder, and wherein the plurality of accommodation recesses extend from ends of the plurality of first gas holes to thereby define expanded flow path areas configured to apply refrigerant received through the plurality of first gas holes to the piston, respectively.

10. The linear compressor of claim 1, wherein the piston comprises a piston body that extends along an inner space of the cylinder in a moving direction of the piston, the piston body comprising an inclined portion that has a diameter decreasing along the moving direction of the piston, and wherein an outer surface of the piston body and an inner surface of the cylinder are spaced apart from each other by a predetermined distance.

11. The linear compressor of claim 10, wherein the inclined portion comprises:

a first inclined portion disposed at a front side of the piston body, the first inclined portion having a first diameter decreasing along a first direction toward the front side of the piston body; and a second inclined portion disposed at a rear side of the piston body opposite to the front side, the second inclined portion having a second diameter decreasing along a second direction opposite to the first direction.

12. The linear compressor of claim 11, wherein the second inclined portion comprises one or more chamfers that define one or more inclination angles.

13. The linear compressor of claim 12, wherein the one or more chamfers comprise:

a first chamfer that defines a first inclination angle with respect to a plane tangential to an outer surface of the piston body; and a second chamfer that is disposed rearward of the first chamfer and that defines a second inclination angle with respect to the plane tangential to the outer surface of the piston body, the second inclination angle being greater than the first inclination angle.

14. The linear compressor of claim 11, wherein each of the first inclined portion and the second inclined portion is inclined with respect to an outer end of the piston body by an angle in a range from 0.1 degrees to 0.7 degrees.

15. The linear compressor of claim 11, wherein the piston further comprises a flange part that radially extends from the rear side of the piston body.

16. A linear compressor comprising:

a casing;

a cylinder that is disposed inside the casing and that defines a compression space configured to accommodate refrigerant;

a piston disposed in the cylinder and configured to reciprocate within the cylinder, the piston being configured to compress the refrigerant accommodated in the compression space; and a drive unit comprising a stator disposed in the casing and a mover configured to move relative to the stator, the mover being coupled to the piston and configured to drive the piston to reciprocate within the cylinder, wherein the piston comprises:

an extension portion that extends in a moving direction of the piston, and an inclined portion that is inclined with respect to a plane tangential to an outer surface of the extension portion, wherein a diameter of the extension portion is greater than a diameter of the inclined portion, wherein the inclined portion comprises:

a first inclined portion disposed forward of a first end of the extension portion, and a second inclined portion disposed rearward of a second end of the extension portion opposite to the first end, the second inclined portion comprising chamfers that have different angles from one another, and wherein a length of the second inclined portion in the moving direction of the piston is greater than a length of the first inclined portion in the moving direction of the piston.

17. The linear compressor of claim 16, further comprising:

a discharge pipe that extends outside of the cylinder and that defines at least a portion of a passage configured to guide refrigerant discharged from the compression space and supply the refrigerant toward the outer surface of the extension portion of the piston;

a frame that supports the cylinder and that surrounds at least a portion of the cylinder, the frame having an inner circumferential surface that faces an outer circumferential surface of the cylinder; and a refrigerant inflow passage that extends along the outer circumferential surface of the cylinder and that is recessed from the inner circumferential surface of the frame.

18. The linear compressor of claim 17, further comprising:

a branch pipe connected to the discharge pipe and configured to guide refrigerant discharged from the discharge pipe toward the refrigerant inflow passage, wherein the frame defines a connection passage that penetrates a front portion of the frame and that connects the branch pipe to the refrigerant inflow passage.

19. The linear compressor of claim 16, wherein the diameter of the extension portion is greater than a diameter each of the first inclined portion and the second inclined portion.

20. The linear compressor of claim 19, wherein the piston further comprises a flange part that is disposed outside of the cylinder and that extends radially outward from the second inclined portion, and wherein a diameter of the flange part is greater than the diameter of the extension portion.

* * * * *